United States Patent [19]

Bunn et al.

[11] 4,445,824

[45] May 1, 1984

[54] VALVE FOR COMPRESSOR CLEARANCE OR BY-PASS CONTROL

[75] Inventors: Stuart E. Bunn; Herbert B. Owsley, both of Shawnee Mission, Kans.

[73] Assignee: Ball Value Co., Inc., Olathe, Kans.

[21] Appl. No.: 317,157

[22] Filed: Nov. 2, 1981

[51] Int. Cl.[3] ..... F04B 23/00

[52] U.S. Cl. ..... 417/440

[58] Field of Search ..... 417/295, 305, 440–442, 417/456–458, 503, 274–277, 296; 92/60.5

[56] References Cited

U.S. PATENT DOCUMENTS

| | | | |
|---|---|---|---|
| 285,955 | 10/1883 | Barry | 137/625.37 |
| 1,291,854 | 1/1919 | Haight . | |
| 1,623,489 | 4/1927 | Naab . | |
| 1,653,110 | 12/1927 | Le Valley . | |
| 1,796,796 | 3/1931 | Le Valley . | |
| 1,985,642 | 12/1934 | Moody . | |
| 2,008,809 | 7/1935 | Wyld . | |
| 2,047,167 | 7/1936 | Heller . | |
| 2,141,069 | 12/1938 | Newell . | |
| 2,726,032 | 12/1955 | Cooper et al. . | |
| 2,751,143 | 6/1956 | Biehn . | |
| 2,833,462 | 5/1958 | Scheerer . | |
| 3,045,892 | 7/1962 | White . | |
| 3,076,593 | 2/1963 | Newton . | |
| 3,295,748 | 1/1967 | Leitgeb . | |
| 3,518,032 | 6/1970 | Degroff et al. . | |
| 3,720,486 | 3/1973 | Jousson et al. | 417/296 |
| 3,746,041 | 7/1973 | Friedland | 251/282 |
| 3,791,776 | 2/1974 | Grant . | |
| 4,043,710 | 8/1977 | Bunn et al. | 417/440 |

FOREIGN PATENT DOCUMENTS

| | | | |
|---|---|---|---|
| 1186275 | 2/1959 | France | 251/282 |

OTHER PUBLICATIONS

*Ball Valve Company Brochure,* "Compressor Cylinder Capacity Control", p. 3.

*Primary Examiner*—William L. Freeh
*Assistant Examiner*—Paul F. Neils
*Attorney, Agent, or Firm*—Litman, Day & McMahon

[57] ABSTRACT

A valve for compressor clearance or by-pass control for a gas compressor having a compressor cylinder which includes a tubular member having a bore communicating with the compressor cylinder, an outer surface and an opening. A valve sleeve receives the tubular member therein and is slidably movable with respect thereto between an open position whereat one of a clearance pocket and a suction chamber communicates with the compressor cylinder through the opening and a closed position closing the opening. A plug is positioned in the tubular member bore and reduces the amount of clearance in the compressor cylinder. Actuator means is provided for moving the valve sleeve between its open and closed positions. The tubular member is attached to an outboard side of a suction valve assembly, and the bore thereof communicates with a passage extending through the suction valve assembly and opening into the compressor cylinder.

4 Claims, 2 Drawing Figures

VALVE FOR COMPRESSOR CLEARANCE OR BY-PASS CONTROL

BACKGROUND OF THE INVENTION

1. Field of the Invention.

This invention relates to compressor controls, and in particular to a valve for communicating a compressor cylinder with one of a clearance pocket and a suction chamber.

2. Description of the Prior Art.

Compressor controls are well-known in the field of compressors, and a variety of different designs have been developed in an attempt to achieve reliable and effective compressor control with minimal effect on overall compressor performance when fully loaded and with minimal complexity of structure.

One type of prior art compressor unloader utilizes mechanical fingers or valve lifters which physically engage and hold the sealing elements of a valve structure in their open positions, whereby no compression can occur. For example, see the Callan U.S. Pat. No. 1,275,843, the Haight U.S. Pat. No. 1,470,077 and the Redfield U.S. Pat. No. 1,505,604, all of which disclose the use of such mechanical fingers or valve lifters for holding plate valves open. Although virtually infinite clearance may be provided through the use of such a system, one of its disadvantages is a loss of compressor efficiency in fully loaded operation due to losses caused by the placement of the finger mechanisms within the valve flow passages. Another disadvantage is that because the fingers must physically contact the sealing elements in a valve, these parts are particularly susceptible to breakage and such unloader systems are therefore characterized by relatively high maintenance costs and down time.

In the case of gas compressors used for the transmission of natural gas, such breakdowns are relatively costly. The entire compressor must usually be shut down so that the damaged unloader mechanisms can be repaired or replaced, which generally requires removing a respective suction valve. The down time of such a compressor represents lost revenue from the natural gas which would otherwise be transmitted during such down time. Also, the natrual gas within the compressor when it is shut down is generally lost to the atmosphere.

To avoid the problems associated with using mechanical fingers or valve lifters for holding valve members in their open positions, compressor unloaders have been devised which utilize pistons sliding within sleeves and thereby opening the compressor cylinder to a clearance pocket or a suction chamber. This type of compressor unloader apparatus is exemplified in our U.S. Pat. No. 4,043,710 wherein a suction valve has a central passage therethrough with an unloader piston slidably disposed therein. A valve is provided for opening a clearance bottle to the compressor cylinder, and the unloader piston is movable between first and second positions whereby the compressor cylinder may be opened to a suction chamber.

Such hollow unloader pistons slidably mounted in sleeves are generally simpler and more reliable than the previously utilized mechanical finger or valve lifter type unloaders. Furthermore, if the unloader pistons are hollow, they offer less area to the compressed gas within the compressor cylinder, are less susceptible to buffeting and may be actuated by actuator mechanisms requiring relatively little force. However, in valves equipped with such unloaders, certain amounts of additional clearance space are formed by the valve central passage and a central passage through such a hollow unloader piston. The total capacity of the compressor when fully loaded is therefore reduced by the introduction of this additional clearance space.

A method of unloading a compressor with an unloader piston slidable in a sleeve communicating with a suction valve passage is exemplified in the Degroff et al U.S. Pat. No. 3,518,032. Because the unloader piston disclosed therein is substantially solid, relatively little additional clearance or head space is added to the compressor cylinder. However, the unloader piston of that device presents a substantial area to the compressor cylinder and is therefore much more susceptible to buffeting by the rapidly increasing and decreasing gas pressures. An actuator having considerable power is thus required to slide the unloader piston.

Prior art compressor controls have therefore tended to be complex either in structure or in manufacture, susceptible to breakdowns, relatively expensive, operated with extensive and powerful actuator means, or tended to reduce the compressor capacity.

SUMMARY OF THE INVENTION

In the practice of the present invention, a compressor clearance control is provided for a gas compressor having a compressor cylinder, a compressor frame with a suction chamber and a valve opening therein, a compressor bottle open to the valve opening and a suction valve assembly with a central passage open to the compressor cylinder and positioned in the valve opening. A tubular member extends from an outboard side of the suction valve assembly and has a bore therethrough communicating with the valve central passage.

A hollow valve sleeve receives the tubular member therein and is slidable with respect thereto between an open position whereat the compressor cylinder is communicated with the clearance bottle through an opening in the tubular member and a closed position closing the opening. Actuator means for moving the hollow valve sleeve comprises a connecting rod attached thereto and threadably engaging the clearance bottle. A hand wheel is provided for rotating the connecting rod. A plug extends through the tubular member bore and the valve central passage and functions to reduce the amount of compressor clearance which the bore and passage would otherwise form.

In an alternative embodiment, a spacer chair is placed between the outboard side of the suction valve assembly and a valve cover over the valve opening and has ports therethrough communicating the valve opening and the suction chamber. When the hollow valve sleeve is in its open position, the compressor cylinder communicates with the suction chamber.

Actuator means are provided for moving the hollow valve sleeve between its opened and closed positions and may comprise, for example, an actuator cylinder with an actuator piston slidably disposed therein and coupled to the unloader sleeve by a connecting rod.

The principal objects of the present invention are: to provide a valve for compressor clearance or by-pass for controlling the capacity of a gas compressor; to provide such an valve which includes a tubular member witha bore therethrough and an valve sleeve receiving the tubular member therein and slidable with respect thereto; to provide such an valve which is adatped for unloading the compressor with a clearance pocket; to provide such an valve wherein the tubular member bore communicates with a passage through a suction valve assembly open to a compressor cylinder; to provide such an valve which may be mounted within a suction valve assembly opening by means of a spacer chair; to provide such an valve wherein the valve sleeve is hollow and open at both ends; to provide such an valve which includes a plug for reducing the compressor clearance or head which would otherwise occur in the tubular member bore; to provide such a valve adapted for use with half-deck suction valves; to provide such a valve which requires relatively little power to actuate; to provide such a valve which is economical to manufacture, efficient in use, reliable, capable of a long operating life, and particularly well adapted for the proposed use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENTS

Figure 1:
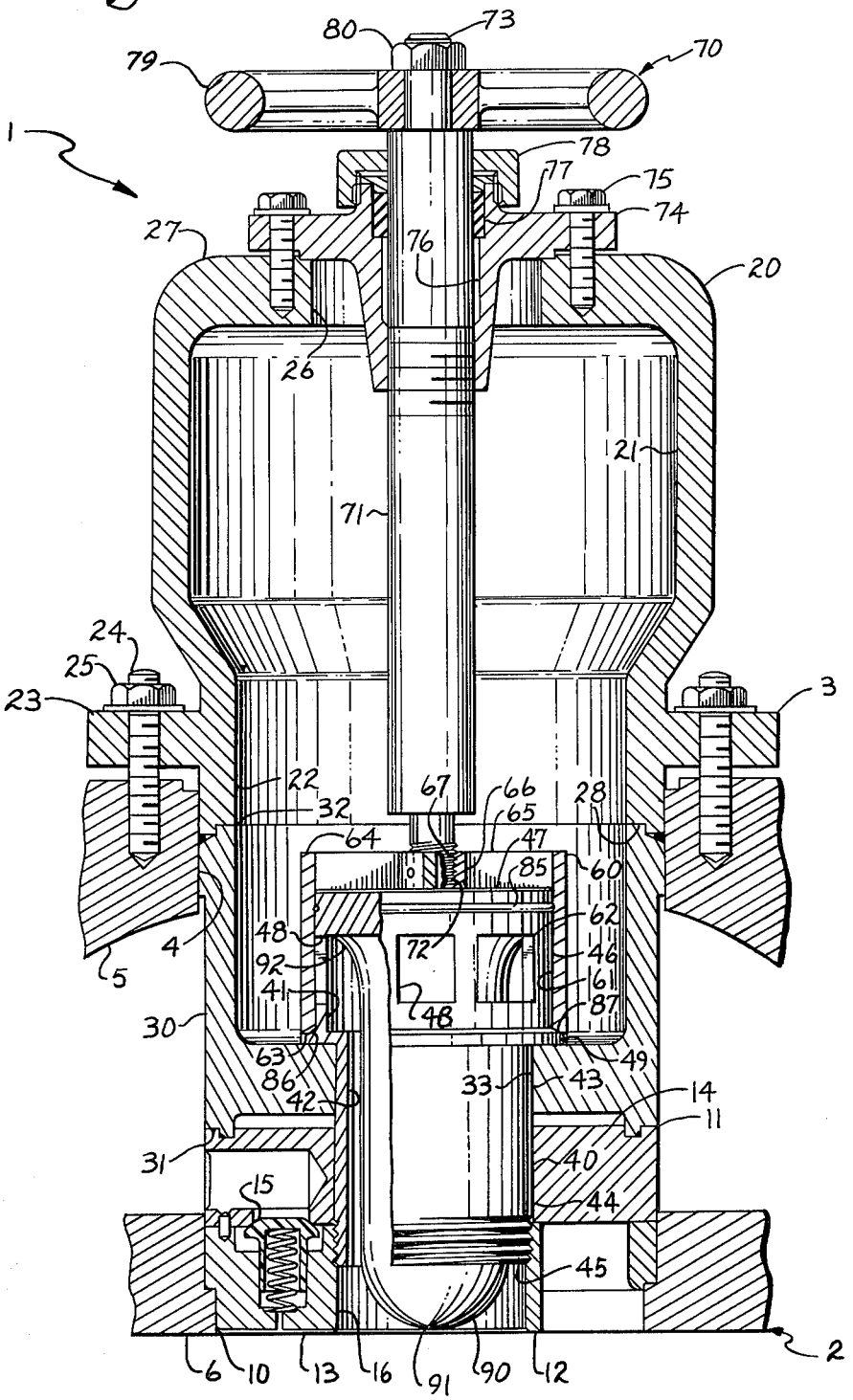
FIG. 1 is a vertical, cross-sectional view of a valve for compressor clearance control embodying the present invention and positioned for fully loaded operation of the compressor.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

For purposes of description herein, the terms "inboard" and "outboard" shall relate to downward and upward directions respectively for the invention as oriented in the drawings. However, it is to be understood that the invention may assume various alternative orientations, except where expressly specified to the contrary.

Referring to the drawings in more detail, the reference numeral 1 generally designates a valve for compressor clearance control for a gas compressor 2 having a compressor frame 3 defining a suction valve opening 4 and a suction chamber 5 surrounding the suction valve assembly opening 4. The compressor frame 3 forms a compressor cylinder 6 communicating with the valve opening 4.

An automatic type suction valve assembly 10 is mounted in the valve opening 4 and includes a cage structure 11 and a seat structure 12 mounted thereon. Outboard and inboard sides 14 and 13 of the suction valve assembly 10 are respectively displayed by the cage and seat structures 11 and 12. The suction valve assembly 10 is a conventional valve assembly of the type commonly referred to as a half-deck valve assembly. A plurality of poppets such as that shown at 15 are slidably mounted in the cage structure 11 for automatically engaging and disengaging the seat structure 12 in response to differential gas pressures between the suction chamber 5 and the compressor cylinder 6. The suction valve assembly 10 allows one-way gas flow from the suction chamber 5 to the compressor cylinder 6. A valve central passage 16 extends through the cage and seat structures 11 and 12 between the outboard and inboard sides 14 and 13 of the valve assembly 10 and is open to the compressor cylinder 6.

A clearance bottle 20 is mounted on the compressor frame 3 and defines a clearance pocket 21 therein communicating with the valve opening 4 through an open mouth 22 at an inboard end 28 of the bottle 20. The clearance bottle 20 includes a peripheral flange 23 adapted to receive bolts 24 which pass through openings in the flange 23 and are threadably received in the compressor frame 3 and secured by nuts 25. An aperture 26 coaxial with the clearance bottle 20 is provided in an outboard end 27 thereof.

A spacer chair 30 is mounted in the valve opening 4 and includes an inboard end 31 engaging the valve assembly outboard side 14 and an outboard end 32 engaging the clearance bottle inboard end 28. With the clearance bottle 20 bolted in place on the compressor frame 3, the spacer chair 30 functions to maintain the suction valve assembly 10 in position adjacent the compressor cylinder 6. The spacer chair 30 includes an aperture 33 aligned and coaxial with the valve assembly central passage 16.

A tubular member 40 having an inner surface 41 defining a bore 42 therethrough and an outer surface 43 is positioned in the valve opening 4 extending from the valve assembly outboard side 14 coaxially with the valve central passage 16. The tubular member 40 includes an inboard portion 44 received within the spacer chair aperture 33 and the central passage 16 and terminating in a threaded inboard end 45 threadably engaging the valve assembly cage structure 11. An outboard portion 46 of the tubular member 40 terminates in a closed outboard end 47 and includes a plurality of circumferentially spaced ports 48 extending between the tubular member inner and outer surfaces 41 and 43 respectively. The respective tubular member inboard and outboard portions 44 and 46 are separated by a peripheral shoulder 49 extending outwardly from the tubular member outer surface 43 and engaging the spacer chair 30. With the tubular member 40 thus screwed tightly into the valve assembly cage structure 11, the spacer chair 30, the valve assembly seat structure 12 and the valve assembly cage structure 11 are all interconnected in axially aligned relation.

A valve sleeve 60 receives therein and is slidable with respect to the tubular member outboard portion 46. The valve sleeve 60 includes an inner surface 61 defining a central passage 62 therethrough, and inboard and outboard ends 63 and 64 respectively. A plurality of radial spokes 65 extend inwardly from the valve sleeve outboard end 64 and terminate at a hub 66 having a threaded aperture 67 therethrough. An actuator assembly 70 is provided for slidably moving the valve sleeve 60 between a closed position as shown closing the ports 48 and an open position opening the ports 48. The actuator assembly 70 includes a connecting rod 71 having a threaded inboard end 72 and a threaded outboard end 73. A cap 74 is mounted on the clearance bottle outboard end 27 and partially within the aperture 33 and has an aperture 76 therethrough, at least a portion of which threadably receives a threaded portion of the connecting rod 71. A packing gland 77 is placed within the cap aperture 76 for maintaining a gas-tight seal with respect to the connecting rod 71 and is secured therein by a packing gland retainer 78. A hand wheel 79 is mounted on the connecting rod outboard end 73 by a nut 80.

An O-ring 85 encircles the tubular member 40 adjacent its outboard end 47 and forms a gas-tight seal with respect to the valve sleeve inner surface 61 which slides with respect thereto. The valve sleeve inboard end 63 includes a beveled edge 86 which engages a corresponding beveled edge 87 at the tubular member shoulder 49. With the valve sleeve 60 in its closed position, it forms a substantially gas-tight seal with respect to the tubular member 40 whereby gas is prevented from entering the clearance pocket 21 through the ports 48.

A plug 90 is attached to the tubular member closed outboard end 47 and extends in an inboard direction therefrom into the bore 42 and the valve central passage 16. The plug 90 includes an expanded tapered outboard end 92 engaging the tubular member outboard end 47 and terminates at a rounded inboard end 91 substantially coplanar with the suction valve assembly inboard side 13.

In operation, the plug 90 occupies a substantial portion of the clearance or head space which would otherwise be added to the volume of the compressor cylinder within the tubular member bore 42 and the valve central passage 16. When the valve sleeve 60 is slid in an outboard direction with respect to the tubular member 40 by turning the hand wheel 79, the ports 48 are thus opened, and the compressor cylinder 6 communicates with the clearance pocket 21 through the bore 42. The gas compressor 2 is thus unloaded and its capacity and horsepower requirements correspondingly reduced, even though the prime mover (not shown) of the compressor 2 operates at a constant speed. The compressor 2 may be returned to loaded operation at full capacity by returning the valve sleeve 60 to its closed position with the hand wheel 79.

The valve sleeve 60 is relatively easy to slide with respect to the tubular member 40 because of its placement on the outside of the tubular member 40 whereby it is not subjected to buffeting from the fluctuating gas pressures within the compressor cylinder 6. Also, the hollow configuration of the valve sleeve 60 offers relatively little surface area to gas pressures which would resist sliding the sleeve 60. Therefore, relatively little effort is required to actuate the valve sleeve 60. Although the actuator assembly 70 as shown is manually operated, automatic actuating mechanisms are well-known and may utilize, for example, pressurized fluid acting on an actuator piston within an actuator cylinder.

Figure 2:
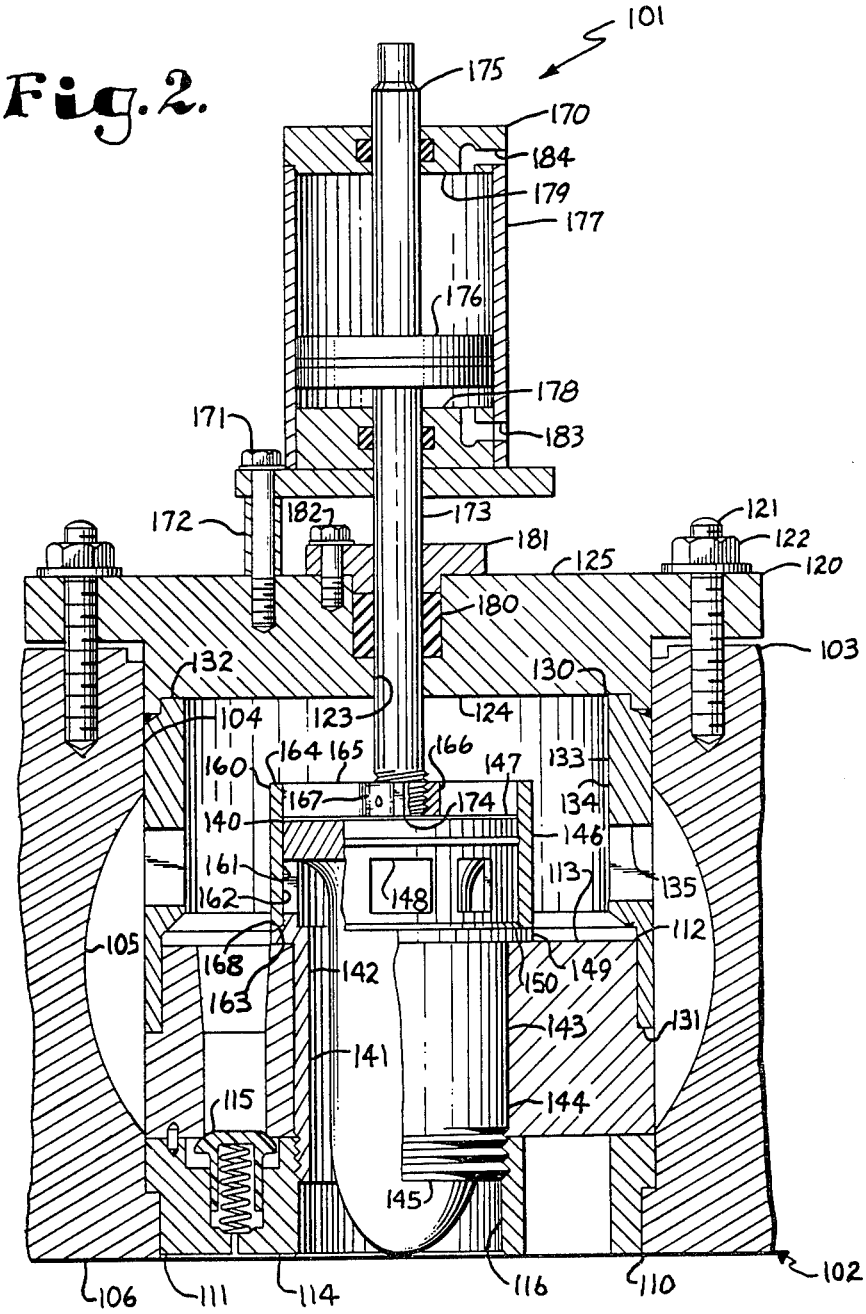
FIG. 2 is a vertical, cross-sectional view of a valve for compressor by-pass control comprising a second alternative embodiment of the present invention and positioned for fully loaded operation of the compressor.

A valve for compressor by-pass control representing a second alternative embodiment of the present invention is shown in FIG. 2 and generally designated by the reference numeral 101. The valve for compressor by-pass control 101 is operably connected to a gas compressor 102 having a frame 103 forming a valve opening 104. The valve opening 104 is encircled by a suction chamber 105 and opens into a compressor cylinder 106.

A half-deck suction valve assembly 110 is positioned in the valve opening 104 and is substantially identical to the valve assembly 10 shown with the first alternative embodiment of the valve for compressor clearance control 1. The valve assembly 110 includes a cage and a seat structure 111 and 112 respectively and displays an outboard and an inboard side 113 and 114 respectively. A plurality of automatic lift-type poppets such as that shown at 115 are movably mounted in the cage structure 111 for selective engagement with the seat structure 112. A central passage 116 extends through the valve assembly 110 between its outboard and inboard sides 113 and 114 and opens into the compressor cylinder 106.

A valve cover 120 is mounted on the compressor frame 103 by bolts 121 and nuts 122. The valve cover 120 includes an aperture 123 therethrough concentric with the valve opening 104 and displays an inboard side 124 adjacent the valve opening 104 and an outboard side 125.

A spacer chair 130 is positioned in the valve opening 104 and includes an inboard end 131 engaging the valve assembly outboard side 113 and an outboard end 132 engaging the valve cover inboard side 124. The spacer chair 130 has an inner surface 133 defining a spacer chair central passage 134 extending therethrough between its ends 131 and 132. A plurality of circumferentially spaced ports 135 communicate the spacer chair central passage 134 and the suction chamber 105.

A tubular member 140 includes an inner surface 141 defining a bore 142 therethrough and an outer surface 143. An inboard portion 144 of the tubular member 140 is received within the valve assembly central passage 16 and terminates in a threaded inboard end 145 threadably received in the valve assembly cage structure 111. An outboard portion 146 of the tubular member 140 extends in an outboard direction from the suction valve 110 and terminates at a closed outboard end 147. A plurality of circumferentially spaced ports 148 extend through the tubular member outboard portion 146 between the inner and outer surfaces 141 and 143 respectively thereof. The tubular member inboard and outboard portions 144 and 146 are separated by a peripheral shoulder 149 extending outwardly from the tubular member outer surface 143 and having a beveled edge 150.

An valve sleeve 160 receives the tubular member outboard portion 156 therein and is slidable with respect thereto. The valve sleeve 160 has an inner surface 161 defining a central passage 162 therethrough and open inboard and outboard ends 163 and 164 respectively. A plurality of spokes 165 extend radially inwardly from the valve sleeve outboard end 164 and terminate at a hub 166 having a threaded aperture 167 therethrough. An O-ring 151 provides a gas-tight seal between the tubular member outer surface 143 and the valve sleeve inner surface 161. When the valve sleeve 160 is in a closed position closing the ports 148 as shown in FIG. 2, the respective tubular member and valve sleeve beveled edges 150 and 168 engage to substantially prevent gas flow therepast.

An actuator assembly 170 is mounted on the valve cover 120 by bolts 171 extending through spacers 172 and into the valve cover 120. The actuator assembly 170 includes a connecting rod 173 having a threaded inboard end 174 threadably engaging the hub threaded aperture 167 and an opposite outboard end 175. By observing the position of the connecting rod outboard end 175 or indicator means (not shown) attached thereto, the loaded or unloaded condition of the compessor 102 can be visually determined. An actuator piston is fixedly mounted on the connecting rod 173 and slidably disposed in an actuator cylinder 177 having an inboard and outboard end 178 and 179 respectively. The connecting rod 173 extends through the valve cover aperture 123 and is maintained in gas-tight sealing relation with respect thereto by a packing gland 180 secured by a packing gland retainer 181 mounted on the valve cover 120 by bolts 182.

Inboard and outboard fluid orifices 183 and 184 respectively communicate fluid from a pressurized fluid source (not shown) to the respective inboard and outboard actuator cylinder ends 178 and 179. When the actuating fluid is directed to the actuator cylinder inboard end 178, the actuator piston 176 is biased in an outward direction, and the valve sleeve 160 is moved to its open position, opening the tubular member ports 148 whereby the compressor cylinder 106 communicates with the suction chamber 105 through the valve central passage 116, the tubular member bore 142, the tubular member ports 148, the valve opening 104 and the spacer chair ports 135. Virtually infinite clearance is thereby provided in the compressor cylinder 106 because the suction valve assembly 110 is thus bypassed, and no compression can occur. In such an unloaded condition, the compressor 102 has no output and the gas within the compressor cylinder 106 is merely pumped back and forth through the valve for compressor by-pass control 101 between the compressor cylinder 106 and the suction chamber 105. As with the previously described embodiment of a valve for compressor clearance control 1, the valve sleeve 160 is relatively easy to actuate between its open and closed positions respectively because it is slidably mounted on the tubular member outer surface 143 and thereby displays relatively little area which is subject to the buffeting of the gas pressures within the valve opening 104.

The actuator assembly 170 may be responsive to operating conditions of the compressor 102 whereby operation of the valve for compressor by-pass control 101 is automatic. For example, in a natural gas transmission system, upon a predetermined gas pressure being attained in a gas transmission line on the discharge side of the compressor 102, actuating fluid may be biased to the acuator cylinder inboard end 78 whereby the valve sleeve 160 is moved to its open position and the compressor 102 unloaded.

It is to be understood that while we have illustrated and described certain forms of our invention, it is not to be limited to the specific forms or arrangement of parts herein described and shown.

What is claimed and desired to secure by Letters Patent is:

1. A valve for by-pass control for a gas compressor having a compressor cylinder, a compressor frame with a suction chamber and a valve opening therein, a valve cover over said valve opening and a suction valve assembly with a central passage open to said compressor cylinder and positioned in said valve assembly, whic comprises:

(a) a tubular member which includes:
  (1) an inner surface defining a bore communicating with said valve assembly central passage;
  (2) an outer surface; and
  (3) a port through said tubular member and selectively communicating said bore with said suction chamber;
(b) a hollow valve sleeve receiving said tubular member therein and slidable with respect thereto; and
(c) actuator means operably connected to said valve sleeve, said actuator means being adapted for moving said valve sleeve between an open position whereat said port is uncovered and said compressor cylinder communcates with said suction chamber therethrough and a closed position whereat said port is closed and fluid flow therethrough between said compressor cylinder and said suction chamber is substantially prevented; and
(d) a plug positioned in said bore and occupying a substantial volume of the space defined thereby.

2. The valve according to claim 1 which includes:
(a) said plug being attached to an outboard end of said tubular member and extending at least substantially the length of said tubular member bore.

3. A valve for by-pass control for a gas compressor having a compressor cylinder, a compressor frame with a suction chamber and a valve opening therein, a valve cover over said valve opening and a suction valve assembly with a passage open to said compressor cylinder and positioned in said valve opening, which comprises:

(a) a tubular member which includes:
  (1) an inner surface defining a bore communicating with said valve assembly passage;
  (2) an outer surface;
  (3) a plurality of circumferentially spaced ports communicating with said bore and said suction chamber;
  (4) an open inboard end engaging an outboard side of said valve assembly;
  (5) a closed outboard end;
(b) a hollow sleeve receiving said tubular member therein and slidable with respect thereto, said hollow sleeve including:
  (1) an inner surface slidably engaging said tubular member outer surface;
  (2) an open inboard end;
  (3) an open outboard end;
  (4) a plurality of spokes attached to said hollow sleeve outboard end and extending radially inwardly therefrom; and
  (5) said spokes terminating at a hub;
(c) a connecting rod connected to said hub and extending outwardly through said valve cover; and
(d) actuator means positioned outboard of said valve cover and engaging said connecting rod, said actuator means being adapted for moving said hollow sleeve between an open position whereat said compressor cylinder communicates with said suction chamber through said ports and a closed position closing said ports; and
(e) a plug positioned in said bore and occupying a substantial volume of the space defined thereby.

4. The valve according to claim 3 which includes:
(a) said plug being attached to said tubular member outboard end and extending at least substantially the length of said tubular member bore.

* * * * *